United States Patent [19]

Dupeuble

[11] 4,386,876

[45] Jun. 7, 1983

[54] PRODUCTION OF ANCHORED TIE-RODS

[75] Inventor: Paul Dupeuble, Noisy-le-Roi, France

[73] Assignee: Sondages Injections Forages (SIF) Enterprise Bachy, France

[21] Appl. No.: 259,088

[22] Filed: Apr. 30, 1981

Related U.S. Application Data

[63] Continuation of Ser. No. 31,134, Apr. 18, 1979, abandoned.

[30] Foreign Application Priority Data

Apr. 18, 1978 [FR] France ..... 78 11345

[51] Int. Cl.[3] ..... E02D 5/74

[52] U.S. Cl. ..... 405/260; 405/269; 405/262

[58] Field of Search ..... 405/233, 239, 260, 261, 405/262, 266, 267, 269; 52/155

[56] References Cited

U.S. PATENT DOCUMENTS

| | | | |
|---|---|---|---|
| 3,494,134 | 2/1970 | Jorge | 405/260 |
| 3,738,071 | 6/1973 | Finsterwalder | 405/260 X |
| 4,069,677 | 1/1978 | Yamada et al. | 405/262 X |
| 4,094,117 | 6/1978 | Torti et al. | 405/260 X |
| 4,124,983 | 11/1978 | Weatherby | 405/260 |
| 4,139,323 | 2/1979 | Brandstetter | 405/260 |
| 4,140,429 | 2/1979 | Herbst | 405/261 |

FOREIGN PATENT DOCUMENTS

| | | | |
|---|---|---|---|
| 2356163 | 5/1975 | Fed. Rep. of Germany | 405/260 |

*Primary Examiner*—David H. Corbin

*Attorney, Agent, or Firm*—Wigman & Cohen

[57] ABSTRACT

The invention relates in particular to a device for producing tie-rods anchored in the ground, which comprises a tubular protective element comprising a top part and a base part and provided on its base part with at least one injection aperture, and at least one element constituting a tie-rod situated inside the tubular element, wherein the part of the element constituting the tie-rod extending along the top part of the tubular element is surrounded by a protective casing, with lubricant inserted between the element constituting the tie-rod and the casing.

14 Claims, 6 Drawing Figures

15
16
19
13
17
2
3
11
1
18
8
5
4
6
9
7
12

15
16
13
17
2
3
11
1
18
8
5
4
6
9
7
12

15
16
23
22
VI
VI
5
5
13
13
2
2
17
17
3
3
11
11
1
1
20
20
8
8
21
21
4
4
9
9
6
6
7
7
12
12
I
I
14
13
12
3
1
1
3
21
12
20

PRODUCTION OF ANCHORED TIE-RODS

This is a continuation of application Ser. No. 31,134, filed Apr. 18, 1979, now abandoned.

BACKGROUND OF THE INVENTION

This invention relates to the production of anchored tie-rods.

In British Patent Specification No. 1,384,744, the applicant has described means for the production of anchored tie-rods which comprises a tubular protective element comprising a top part and a base part, with apertures which are advantageously fitted with valves distributed on the base part of the said tubular element, an element constituting a tie-rod situated inside the tubular element, an injection tube extending along the whole length of the tubular element and comprising at least one injection aperture on the part of its length extending along the base part of the tubular element, and a stopper placed inside the tubular element, at the junction of the base part and the top part of the tubular element and through which pass the element constituting the tie-rod and the injection tube, shutting off the inside of the base part from the outside. Also described is a process for producing anchored tie-rods utilising such means, comprising insertion of the means into a bore-hole in the ground, shutting off from the outside the annular space which exists between the wall of the bore-hole and the base part of the tubular element which is to be fixed into the ground, and injecting mortar or cement under pressure through the injection tube incorporated in the means, so as to cause simultaneously the sealing of the element constituting the tie-rod inside the base part of the tubular element and the sealing of the base part of the tubular element in the ground, the mortar or cement penetrating into the ground after having passed through the apertures provided on the base part of the tubular element.

Although the means of British Patent Specification No. 1,384,744 permits the production of satisfactory tie-rods, it does have the disadvantage of being rather complicated to manufacture, since it is necessary to place in the protective tubular element an element constituting the tie-rod and an injection tube passing through a stopper provided at the junction of the base part and the top part.

SUMMARY AND OBJECTS OF THE INVENTION

The invention aims to simplify the production of tie-rods anchored in the ground and generally covers for this application the use of an element constituting, a tie-rod (for example a cable or bar) which is covered on a portion of its length by a casing or sheath, with a layer of lubricant inserted between the element constituting the tie-rod and the casing.

According to the invention there is provided means for the production of tie-rods anchored in the ground which comprises (1) a protective tubular element comprising a top part and a base part and provided on its base part with at least one injection aperture, and (2) at least one element constituting a tie-rod placed inside the tubular element, wherein the part of the element constituting the tie-rod which extends along the top part of the tubular element is surrounded by a protective casing, with lubricant inserted between the element constituting the tie-rod and the casing.

The invention also relates to a process for the production of tie-rods anchored in the ground, which comprises the following steps:

(a) introduction of a device according to the invention into a bore-hole in the ground, (b) shutting-off with regard to the exterior of the annular space which exists between the wall of the bore-hole and the base part of the tubular element to be fixed into the ground, (c) injection under high pressure of mortar, cement or any other suitable setting composition into the protective tubular element, so that the mortar or cement fills the said tubular element then passes through the injection aperture provided on the base part of the said tubular element and penetrates into the surrounding ground, and (d) after the cement has set, constraint of the covered part of the element constituting the tie-rod.

According to a variation of this process, instead of introducing the device of the invention as a whole into the bore-hole, just the tubular element could first be introduced and then, in any order, (i) the element constituting the tie-rod placed in the tubular element, and (ii) the shutting-off stage (b) carried out.

BRIEF DESCRIPTION OF THE DRAWING

An embodiment of the invention will now be described, by way of example, with reference to the accompanying drawings, in which.

DETAILED DESCRIPTION OF THE PREFERRED EMBODIMENTS

Figure 1:
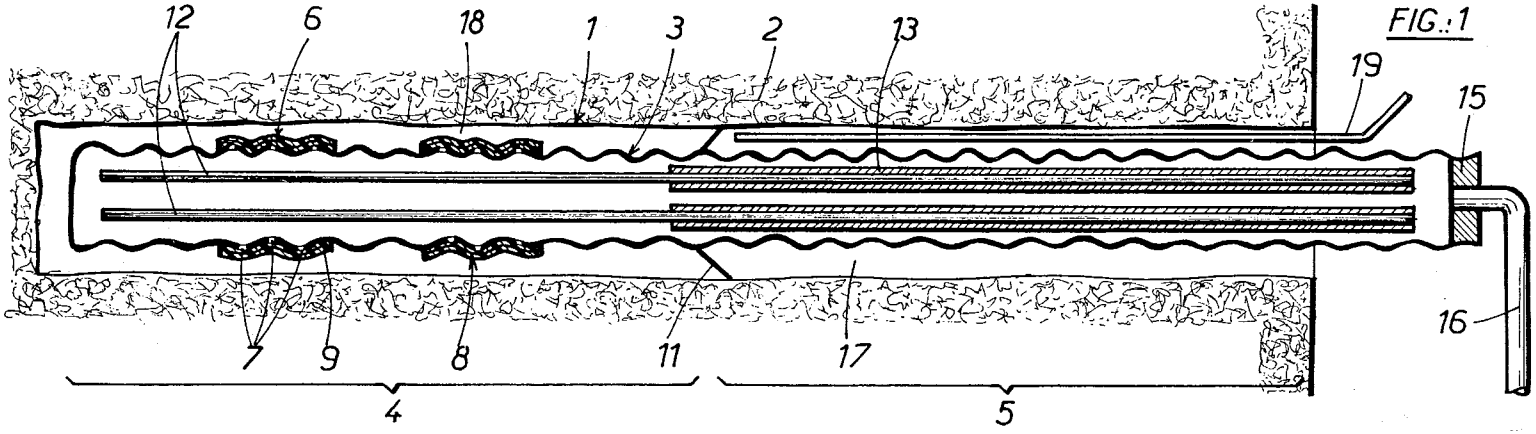
FIGS. 1 to 4 are views illustrating diagrammatically the steps involved in the production of a tie-rod anchored in the ground.

In FIG. 1 can be seen a bore-hole 1, which is approximately cylindrical, made in the ground 2 into which the tie-rod is to be anchored. This bore-hole 1 can be made by any known method, for example by means of a rotating, percussive or rotary-percussive drilling tool. Means according to the invention, comprising a protective tube 3 and two elements 12 constituting tie-rod placed in the tube 3, has been introduced into the bore-hole 1.

The tube 3, which can be made of steel, plastics or any other suitable material, comprises two successive parts, that is a base part 4 which goes at the bottom of the bore-hole and is used for fixing into the ground, and a top part 5, generally longer than part 4. The total length of the tube 3 is usually from several meters to several tens of meters. The base part 4 which is usually closed at its lower end includes injection means 6 distributed at regular intervals (for example every meter) along its length. These injection means comprise, for example, apertures 7 made in part 4 of the tube and covered with foil 8 which is itself covered with a resilient membrane 9, for example rubber, surrounding the tube 3. The injection means 6 enable mortar, cement or any other suitable composition to be injected into the ground from the interior of part 4 of the tube 3, the foil 8 and the membrane 9 forming a valve for each aperture 7 and preventing the injected product from returning into the tube. Of course, instead of the injection means 6 any other arrangement which is technically equivalent could be used.

The top part 5 of the tube 3 is free from injection means 6, as illustrated. A separation device 11 in the form of an annulus is fixed on the tube 3 at the point where the base part 4 and the top part 5 join. This device 11 is made from a resilient material, for example rubber, incorporating a flexible framework if necessary. Once the tube 3 is placed in the bore-hole, the device 11 takes the form of a corolla, as can be seen in FIG. 1.

The outer surface of the tube can be of any form, for example helical, as shown. It could also be smooth or comprise projections or other similar means serving to increase its adherence to the ground and to the product which is to be injected.

Two elements constituting tie-rods designated by a general reference 12 are placed inside the protective tube 3. Each of these elements 12 comprises a cable or a metallic bar, the part of the cable which extends along the base part 4 of the tube 3 being uncovered and the part extending along the top part 5 being covered by a casing 13, for example made of a plastics material such as polyethylene, with a thin layer of lubricant such as grease being inserted between the cable and the casing. It should be noted that lubricated, covered cables needed for the purpose of the invention are commercially available, and that is is sufficient to remove the casing and the lubricant on the part to be extended along the base part of the protective tube in order to obtain an element 12. The lubricant inserted between the cable and its casing generally has anti-corrosive properties.

As shown in FIG. 1, the protective tube 3 is a little longer at its free end than the elements constituting the tie-rods 12 and is provided with a blanking plug 15 fitted with a pipe 16 for supplying the mortar, cement or other setting composition which is being injected. The tube 3 and elements 12 are of a sufficient length to project slightly beyond the surface of the ground 2, as shown.

Having placed the assembly in the bore-hole 1, cement is then injected into the annular space 17 between the wall of the bore-hole 1 and the top part 5 of the protection tube 3, so that, when this cement has hardened, the annular space 18 between the wall of the bore-hole 1 and the base part 4 of the protection tube 3 is shut off from the outside. This injection can be effected very simply by placing an injection tube 19 from the outside into the annular space 17 and then allowing the cement to pass through the tube under low pressure until it has filled the space 17. The injected cement is prevented from filling up the annular space 18 by the separating means 11.

Figure 2:
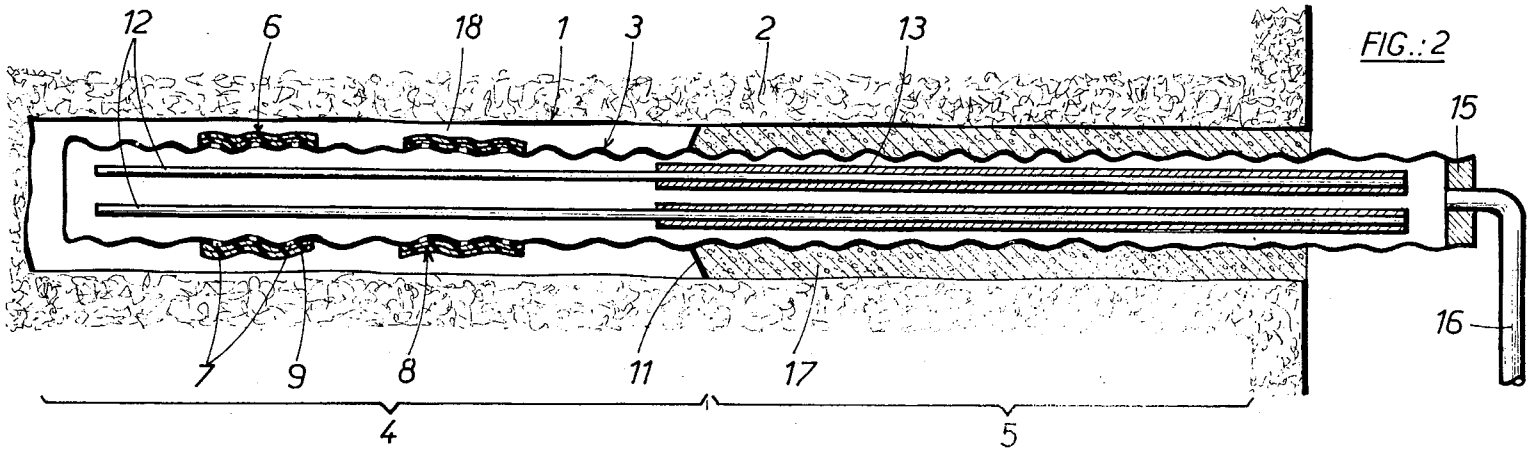

After the cement has set in the annular space 17 (FIG. 2), mortar, cement or any other suitable setting composition is injected under high pressure through the pipe 16 into the protective tube 3. The injected material starts by filling the interior of the tube 3, encasing the elements constituting the tie-rods 12, then goes out through the injection means 6, filling the annular space 18, and finally spreads radially through the surrounding ground. After the injected material has hardened, a block 20 is obtained which fixes the tube 3 firmly into the surrounding ground and completely encloses it, thus protecting it from corrosion if the tube 3 is made of metal, together with a sealing 21 which seals the uncovered parts of the elements 12 constituting tie-rods at the base part 4 of the tube 3 (FIGS. 3 and 5).

After that, the portion of the protection tube 3 projecting from the bore-hole is removed, the part of the elements 12 projecting from the bore-hole is exposed by removing the matrix of the hardened injected material which covers it and the casing and lubricant which surround it, then the lubricated and encased part of each element 12 is prestressed owing to the ability of the part of the cable or bar extending through the top part of the protective tube 3 to slide inside its casing owing to the thin layer of lubricant. It should be noted in this respect that the friction of the cable or bar inside its casing is, on account of the presence of lubricant, negligible in relation to the tensile stress to which the cable or bar is submitted when being prestressed, which causes a certain amount of stretching of the cable or bar (FIGS. 4 and 6).

Figures 3, 4, 5, 6:
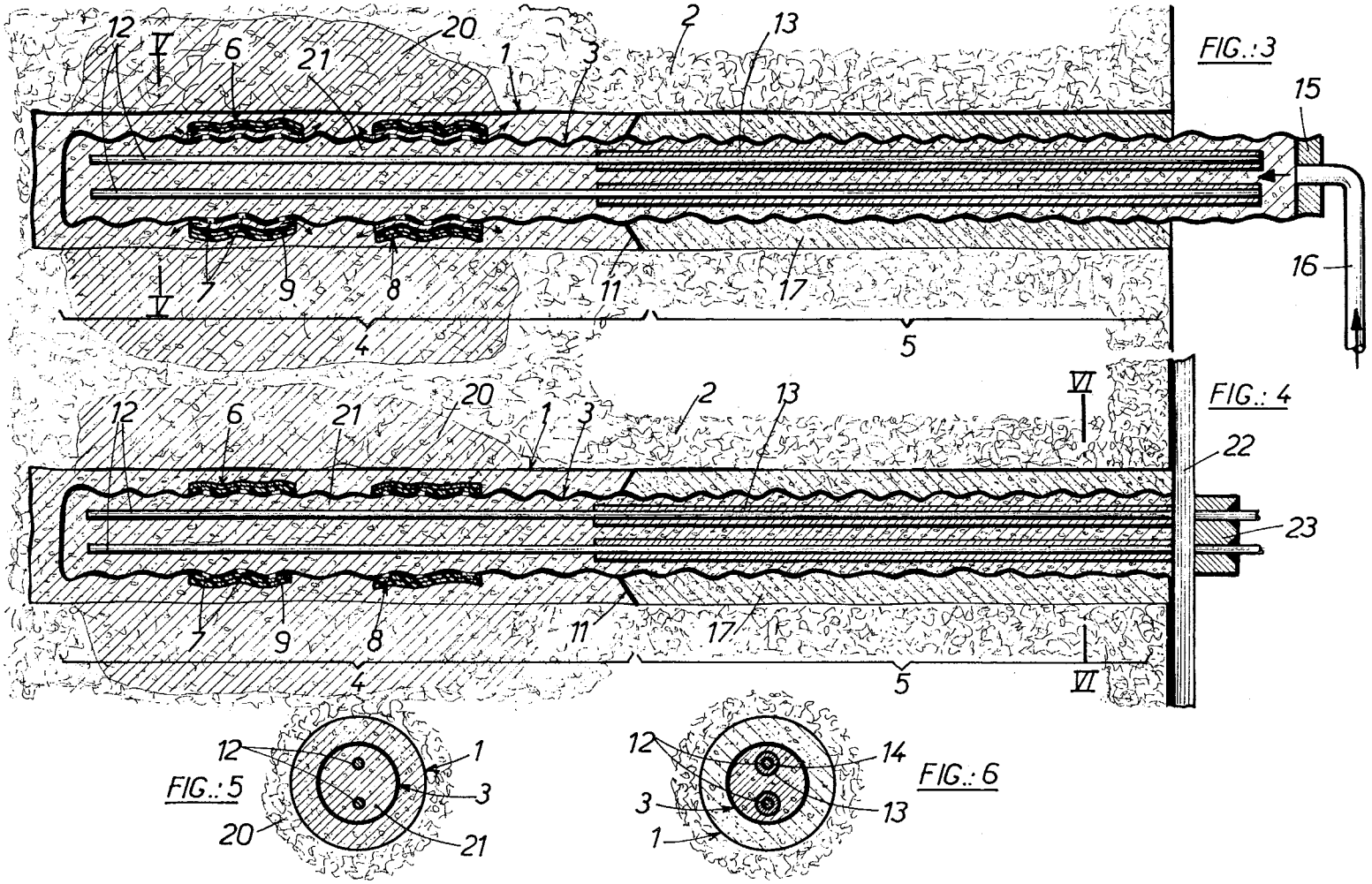
FIGS. 5 and 6 are sectional views along the lines V—V and VI—VI of FIGS. 3 and 4, respectively.

The anchored tie-rod which is obtained is suitable for supporting any structure against the sides of the ground, for example a sheet-piling wall or prefabricated concrete wall, as shown diagrammatically at 22 in FIG. 4, with a fixing head 23 supporting the elements 12 constituting the tie-rods under prestressed tension.

The invention has numerous advantages in relation to the previous method described in British Patent Specification No. 1,384,744 mentioned above, i.e.:

manufacture of the element in the workshop is simplified owing to the removal of the interior stopper and of the injection tube incorporated in the device, and operation is simplified owing to more efficient injection of the sealing, since the omission of the interior stopper removes a frequent source of trouble in the case of defective manufacture or deterioration in handling.

Furthermore, the invention makes it possible to dispense with secondary injecting operations which were necessary to protect the part of the elements constituting the tie-rods in the top part of the protective tube from corrosion.

It goes without saying that the method described above is only given as an example and that it would be possible to modify it, particularly by substituting equivalent techniques, without departing from the scope of the invention.

I claim:

1. A device for use in the production of a tie-rod anchored in the ground, comprising a protective tubular element having a top part and a base part, and provided in its base part with at least one injection aperture and at least one metallic element constituting a tie-rod placed inside the tubular element, the part of the element constituting the tie-rod which extends through the top part of the tubular element being enclosed by a protective casing, with lubricant inserted between the element constituting the tie-rod and the casing, the part of the element constituting the tie-rod which extends through the base part of the tubular element being surrounded by said base part, and annular separating means affixed around the tubular element at the location where the base part and top part merge for preventing the annular space between the wall of the bore-hole and the base part of said tubular element to be filled with setting composition used for filling the annular space between the wall of the bore-hole and the top part of said tubular element.

2. The device according to claim 1, wherein said annular separating means is a disk.

3. A process for the production of a tie-rod anchored in the ground, comprising the following steps:

(a) introduction into a bore-hole in the ground of a device comprising a protective tubular element having a top part and a base part, and separating means in the form of a disk affixed to the outer wall of the tubular element at the location where the base part and top part merge, and provided in its base part with at least one injection aperture and at least one metallic element constituting a tie-rod placed inside the tubular element, the part of the element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, the bore-hole having a larger diameter than the device, (b) sealing from the exterior the annular space between the wall of the bore-hole and the base part of the tubular element by injecting a suitable setting composition to fill the annular space between the separating means and the top of the bore-hole to thereby facilitate the filling of said tubular element and the surrounding ground with a setting composition, (c) injection under high pressure of mortar, cement or any other suitable setting composition into the protective tubular element, so that the mortar or cement fills the said tubular element and then passes through the injection aperture provided in the base part of the said tubular element and penetrates into the surrounding ground, and (d) after the cement has set, stressing the covered part of the metallic element constituting the tie-rod.

4. The process according to claim 3, wherein said disk affixed to the outer wall of said tubular element is made of a resilient material which takes the form of a corolla.

5. A process for the production of a tie-rod anchored in the ground, comprising the following steps:

(a) introduction into a bore-hole in the ground of a device comprising a protective tubular element having a top part and a base part, and separating means in the form of a disk affixed to the outer wall of the tubular element at the location where the base part and top part merge, and provided in its base part with at least one injection aperture, the bore-hole having a larger diameter than the device, (b) at least one metalic element constituting a tie-rod is placed inside the tubular element, the part of the metallic element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, (c) sealing from the exterior the annular space between the wall of the bore-hole and the base part of the tubular element by injecting a suitable setting composition to fill the annular space between the separating means and the top of the bore hole to thereby facilitate the filling of said tubular element and the surrounding ground with a setting composition, (d) injection under high pressure of mortar, cement of any other suitable setting composition into the protective tubular element, so that the mortar or cement fills the said tubular element and then passes through the injection aperture provided in the base part of the said tubular element and penetrates into the surrounding ground, and (d) after the cement has set, stressing the covered part of the metallic element constituting the tie-rod.

6. The process according to claim 5, wherein said disk affixed to the outer wall of said tubular element is made of a resilient material which takes the form of a corolla.

7. A process for the production of a tie-rod anchored in the ground, comprising the following steps:

(a) introduction into a bore-hole in the ground of a device comprising a protective tubular element having a top part and a base part, and separating means in the form of a disk affixed to the outer wall of the tubular element at the location where the base part and top part merge, and provided in its base part with at least one injection aperture, the bore-hole having a larger diameter than the device, (b) sealing from the exterior the annular space between the wall of the bore-hole and the base part of the tubular element by injecting a suitable setting composition to fill the annular space between the separating means and the top of the bore-hole to thereby facilitate the filling of said tubular element and the surrounding ground with a setting composition, (c) at least one metallic element constituting a tie-rod is placed inside the tubular element, the part of the element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, (d) injection under high pressure of mortar, cement or any other suitable setting composition into the protective tubular element, so that the mortar or cement fills the said tubular element and then passes through the injection aperture provided in the base part of the said tubular element and penetrates into the surrounding ground, and (e) after the cement has set, stressing the covered part of the metallic element constituting the tie-rod.

8. The process according to claim 7, wherein said disk affixed to the outer wall of said tubular element is made of a resilient material which takes the form of a corolla.

9. A process for the production of a tie-rod anchored in the ground, comprising the following steps:

(a) introducing into a bore-hole in the ground a device comprising a protective tubular element having a top part and a base part, and annular separating means positioned between the outer wall of the tubular element and the bore-hole at the location where the base plate and top part merge, and provided in its base part with at least one injection aperture and at least one metallic element constituting a tie-rod placed inside the tubular element, the part of the element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, the bore-hole having a larger diameter than the device, (b) sealing from the exterior the annular space between the wall of the bore-hole and the base part of the tubular element by injecting a suitable setting composition to fill the annular space between the separating means and the top of the bore-hole to thereby facilitate the filling of said tubular element and the surrounding ground with a setting composition, (c) injection under high pressure of mortar, cement or any other suitable setting composition into the protective tubular element, so that the mortar or cement fills the said tubular element and then passes through the injection aperture provided in the base part of the said tubular element and penetrates into the surrounding ground, and (d) after the cement has set, tensioning the covered part of the metallic element constituting the tie-rod.

10. The process according to claim 9, wherein said annular separating means recited in step (c) is a disk element which is affixed to the outer wall of said tubular element to form a barrier in the annular space between said bore-hole and said tubular element.

11. A process for the production of a tie-rod anchored in the ground, comprising the following steps:

(a) introducing into a bore-hole in the ground a device comprising a protective tubular element having a top part and a base part, and annular separating means positioned between the outer wall of the tubular element and the bore-hole at the location where the base part and top part merge, and provided in its base part with at least one injection aperture, the bore-hole having a larger diameter than the device, (b) placing at least one metallic element constituting a tie-rod inside the tubular element, the part of the metallic element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, (c) sealing from the exterior the annular space between the wall of the bore-hole and the base part of the tubular element by injecting a suitable setting composition to fill the annular space between the separating means and the top of the bore hole to thereby facilitate the filling of said tubular element and the surrounding ground with a setting composition, (d) injecting under high pressure mortar, cement or any other suitable setting composition into the protective tubular element, so that the mortar or cement fills the said tubular element and then passes through the injection aperture provided in the base part of the said tubular element and penetrates into the surrounding ground, and (e) after the cement has set, tensioning the covered part of the metallic element constituting the tie-rod.

12. The process according to claim 11, wherein said annular separating means recited in step (c) is a disk element which is affixed to the outer wall of said tubular element to form a barrier in the annular space between said bore-hole and said tubular element.

13. A process for the production of a tie-rod anchored in the ground, comprising the following steps:

(a) introducing into a bore-hole in the ground a device comprising a protective tubular element having a top part and a base part, and annular separating means positioned between the outer wall of the tubular element and the bore-hole at the location where the base part and top part merge, and provided in its base part with at least one injection aperture, the bore-hole having a larger diameter than the device, (b) sealing from the exterior the annular space between the wall of the bore-hole and the base part of the tubular element by injecting a suitable setting composition to fill the annular space between the separating means and the top of the bore-hole to thereby facilitate the filling of said tubular element and the surrounding ground with a setting composition, (c) placing at least one metallic element constituting a tie-rod inside the tubular element, the part of the element constituting the tie-rod which extends through the top part of the tubular element being enclosed by a protective casing, with lubricant inserted between the element constituting the tie-rod and the casing, and the part of the element constituting the tie-rod which extends through the base part of the tubular element being surrounded by said base part, (d) injecting under high pressure of mortar, cement or any other suitable setting composition into the protective tubular element, so that the mortar or cement fills the said tubular element and then passes through the injection aperture provided in the base part of the said tubular element and penetrates into the surrounding ground, and (e) after the cement has set, tensioning the covered part of the metallic element constituting the tie-rod.

14. The process according to claim 13, wherein said annular separating means recited in step (c) is a disk element which is affixed to the outer wall of said tubular element to form a barrier in the annular space between said bore-hole and said tubular element.

* * * * *

UNITED STATES PATENT AND TRADEMARK OFFICE

CERTIFICATE OF CORRECTION

PATENT NO. : 4,386,876

DATED 6/7/83

INVENTOR(S) : PAUL DUPEUBLE

It is certified that error appears in the above—identified patent and that said Letters Patent is hereby corrected as shown below:

Column 5, line 62, change "of", second occurrence, to --or--.

Column 2, line 44 "tie-rod" should be --tie-rods--.

Signed and Sealed this

Tenth Day of September 1985

[SEAL]

*Attest:*

DONALD J. QUIGG

*Attesting Officer* *Acting Commissioner of Patents and Trademarks - Designate*